United States Patent [19]

Wittmann

[11] Patent Number: 4,738,630

[45] Date of Patent: Apr. 19, 1988

[54] SOCKET FOR RECEIVING THE BASE OF A SINGLE-BASED FLUORESCENT LAMP

[75] Inventor: Horst Wittmann, Stadtbergen, Fed. Rep. of Germany

[73] Assignee: Patent-Treuhand-Gesellschaft für elektrische Glühlampen mbH, Munich, Fed. Rep. of Germany

[21] Appl. No.: 851,772

[22] Filed: Apr. 14, 1986

[30] Foreign Application Priority Data

Apr. 16, 1985 [DE] Fed. Rep. of Germany ... 8511243[U]

[51] Int. Cl.[4] ..... H01R 33/08

[52] U.S. Cl. ..... 439/226; 439/602; 313/318

[58] Field of Search ..... 339/50 R, 54, 56, 91 L, 339/176 L, 278 L, 221 L, 125 L, 119 L, 50 C, 55, 59 L, 61 L, 132 T; 313/317, 318, 324

[56] References Cited

U.S. PATENT DOCUMENTS

| | | | |
|---|---|---|---|
| 3,160,458 | 12/1964 | Laudel, Jr. et al. | 339/191 R |
| 3,339,172 | 8/1967 | Heath | 339/91 L |
| 3,407,717 | 10/1968 | Ernisse | 339/91 L |
| 3,800,267 | 3/1974 | Burgess et al. | 339/61 L |

FOREIGN PATENT DOCUMENTS

| | | | |
|---|---|---|---|
| 1907857 | 2/1969 | Fed. Rep. of Germany | 339/59 L |

*Primary Examiner*—Gil Weidenfeld
*Assistant Examiner*—Thomas M. Kline
*Attorney, Agent, or Firm*—Frishauf, Holtz, Goodman & Woodward

[57] ABSTRACT

A cover module (1) of an adaptor for single-based fluorescent lamps is provided with a cylindrical element, having a cross-sectionally rectangular recess (2) therein, for receiving the base of the lamp. Spring elements (5) for gripping the base are formed on opposing interior sidewalls of the recess (2). The lower ends (6) of the spring elements (5) are integrally formed with the cover module (1) and the play or travel of each of their upper ends (7) is limited by a stop (10) formed on the cover module (1). Between the upper (7) and lower (6) ends, detents (8) are formed on the spring elements (5) forcibly engage behind, in the direction of lamp insertion, cam surfaces (12) on the lamp base. The force, with which the lamp base is held in the cover module (1), is selectable within a certain range, dependent upon the spacing of the play-limiting stops (10), thus assuring a secure mechanical engagement of the lamp in the cover module socket.

5 Claims, 2 Drawing Sheets

SOCKET FOR RECEIVING THE BASE OF A SINGLE-BASED FLUORESCENT LAMP

The present invention relates generally to a socket for receiving the base of a single-based low-pressure mercury vapor discharge lamp, and more particularly to a socket for a compact fluorescent lamp, similar to that shown in U.S. Pat. No. 4,481,442, ALBRECHT et al., assigned to the assignee of the present invention.

BACKGROUND

Generally such lamps are held, in a socket composed of insulating material, by spring elements having detents which engage behind cam surfaces formed on the lamp's insertion stem. Such a socket is described in U.S. Pat. No. 4,426,602 and corresponding German Patent Disclosure Document DE-OS No. 31 21 077, which discloses a socket having a plastic housing with a U-shaped metal strip inside, whose ends are bent into semi-circular detents which engage behind the cam surfaces on the insertion stem of the lamp. For reasons of electrical safety, it would be desirable to avoid such a construction, and to limit the metal components within the socket to those which are necessary to provide the electrical contact between the lamp base and the socket.

THE INVENTION

Accordingly, it is an object of the present invention to provide a structure for mechanically holding the lamp, in which the use of metallic spring elements is avoided.

Briefly, the socket and the spring elements are integrally formed as a single unit, in which the lower ends of the spring elements are connected to the socket, and the play of the upper ends of the spring elements is limited by stops formed on the socket. The upper ends of the spring elements extend beyond the detents so that these detents, in contrast to the detents of the aforementioned U.S. Pat. No. 4,426,602 and DE-OS No. 31 21 077, are disposed between the upper and lower ends of the spring elements. The stops formed on the socket, for the spring elements, are defined by the upper limit surface of the socket.

In their rest position, the spring elements have their upper ends slightly inclined toward one another. Upon insertion of the lamp base, the cam surfaces thereon press the spring elements apart until the upper ends rest against the stops of the socket. Viewed in the insertion direction, the cams on the insertion stem at this stage or position are still before the detents of the spring elements. For further insertion of the base into the socket, a certain force must be exerted to slide the wedge-shaped cam surfaces past the detents, which are preferably also wedge-shaped. This requires pressing the spring elements even further apart. After the cam surfaces have passed, in the insertion direction, the point of maximum pressure, the base has finally been inserted in the socket, and a reduced tensioning of the spring elements results, although the cam surfaces remain engaged with the detents. The lamp base is now mechanically secure and held interlockingly and under spring pressure within the socket.

The socket of the present invention is equally usable for mounting in a fixture and as a housing element of an adaptor containing a heating and ignition circuit for the lamp. Since the socket, including the spring elements, is integrally formed from a single material and in a single piece, it can be produced by injection molding. The additional metal strip production and assembly steps of the prior art structure can be eliminated, which means that tooling, materials, and assembly costs are substantially reduced with the socket of the present invention. The electrical safety of the socket is improved over that of prior art sockets, since the spring elements which grip the base and hold the lamp are now composed of an insulating material. The integration of the stops for the upper ends of the springs into the socket structure significantly improves the mechanical holding of the lamp, since such a construction eliminates metal fatigue. Furthermore, the choice of the thickness of the cams on the lamp base and/or of the spacing of the opposing stops permits selection of the desired spring pressure, and thereby the specification of the force, with which the base is held in the socket.

DRAWINGS

DETAILED DESCRIPTION

Figure 1:
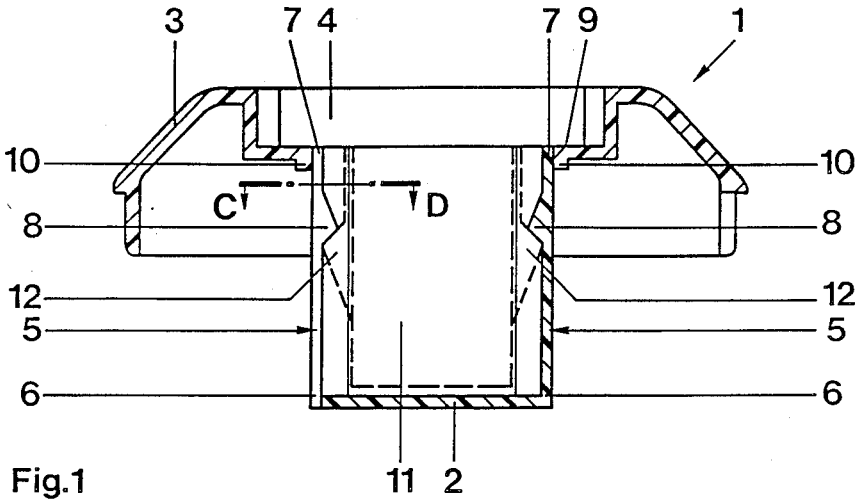
FIG. 1 is a cross-sectional view of the cover module, with inserted lamp base shown in phantom, taken along the broken section line A–B indicated in FIG. 2.

The cover module 1 shown in FIG. 1 is preferably injection-molded of a plastic, such as the thermoplastically processed polyester sold by Bayer AG under the trademark POCAN, U.S. Pat. No. 1,030,427. It comprises essentially an elongated hollow housing, preferably a cross-sectionally rectangular recess 2 and a housing portion 3 which defines the upper boundary of the recess 2. The upper end of the recess 2 broadens into a widened portion 4. On each of two opposing sidewalls of the recess 2, a spring element 5 is formed. The lower ends 6 of the spring elements are connected to the bottom wall of the recess 2 and the upper ends 7 of the spring elements 5 have a certain degree of play or range of travel. A double-wedge-shaped or double-ramp-shaped detent 8 is formed on each spring element 5, intermediate the lower end 6 and the upper end 7, and projects from the substantially planar surface of the spring into the recess 2 toward the opposing sidewall and spring element. Preferably, the slope of the ramp portion nearest the opening of the recess is gentler, i.e. forms a smaller angle to the plane of the sidewall from which it projects, than the slope of the ramp portion nearest the bottom of the recess. The two ramp portions come together at the point of maximum projection from the sidewall.

The spring elements 5 and their projecting detents 8 are formed together with rest of the cover module 1 and recess 2 as a single piece in a single working step. The upper ends 7 of the spring elements 5 are free and terminate adjacent the lower boundary or limit surface 9 of the widened housing portion 4. Here, on each side, a stop 10 is formed on the lower boundary surface 9. The stops limit the outward travel of the spring elements 5 with respect to each other and to the central axis of the recess.

FIG. 1 shows in phantom the insertion stem 11 of the lamp base. The insertion stem 11 has a cross-section corresponding to that of the recess 2. Preferably, the cross-section is rectangular, and the major dimension of the stem 11 is greater than the minor dimension of the recess 2, so that the stem 11 cannot fit into the recess if inadvertently rotated 90° from the proper orientation, i.e. the orientation in which cam surfaces 12 on the stem 11 engage detents 8 on the spring elements 5.

These cam surfaces 12 are formed on opposing sides of the insertion stem 11, and engage behind, in the direction of lamp insertion, the detents 8. Preferably, the cam surfaces 12, like the detents 8, have a double-ramp configuration, with the slope, with respect to the substantially planar side surface of the insertion stem, of the cam surface ramp portion farther away from the end of the insertion stem matched to the slope of the detent ramp portion farther away from the opening of the recess. Due to the spreading force exerted by the cam surfaces 12, the upper ends 7 of the spring elements 5 are pressed against the stops 10. This assures a secure mechanical holding of the base in the socket.

Figure 2:
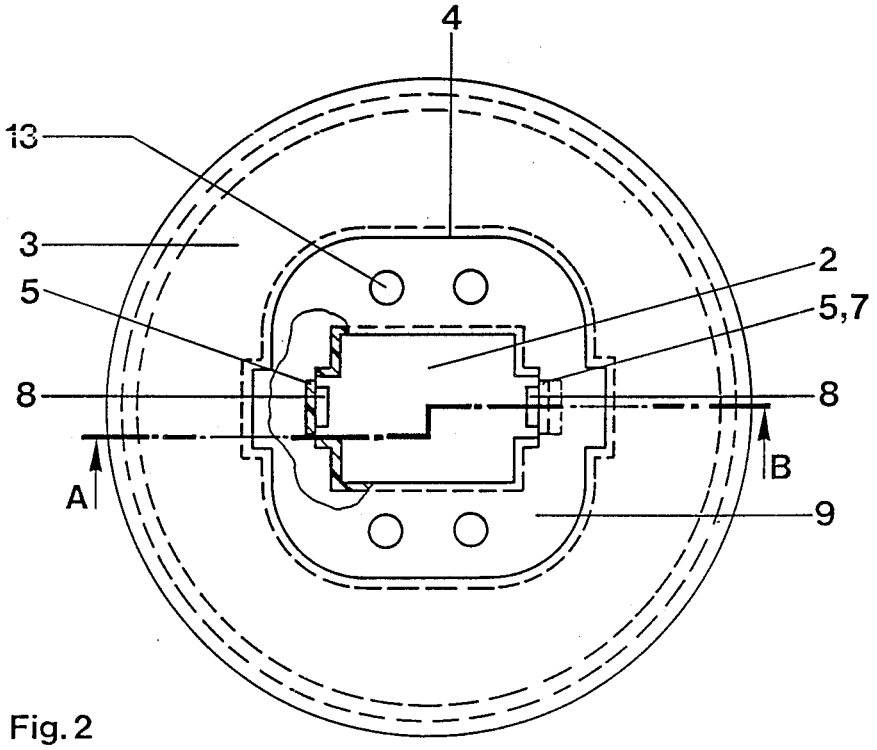
FIG. 2 is a top view of the cover module, partially broken away to show a section along line C–D of FIG. 1.
Figure 3:
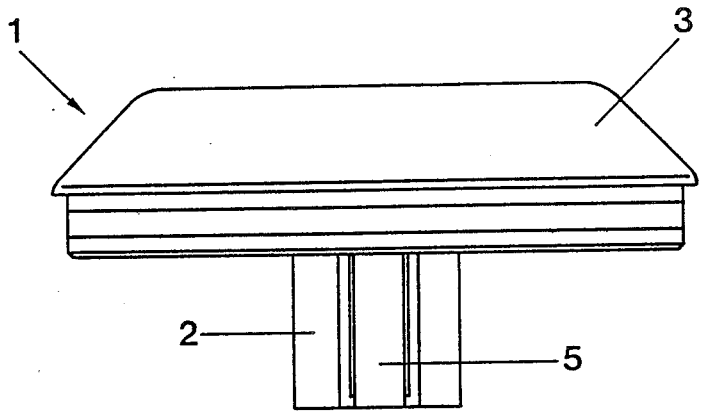
FIG. 3 is an exterior side view of the cover module of FIG. 1, rotated 90° about the vertical axis.

FIG. 2 illustrates the rectangular cross-section of the recess 2. Also shown are four pinholes 13 in the lower boundary surface 9 of the widened housing portion 4. Upon insertion of the lamp, two or four, as the case may be, contact pins or terminals of the lamp base project through matching pinholes 13, with a different pin combination being used for different lamp wattages, so that appropriate matching to the heating and/or ignition circuit (not shown) contained in the housing is assured.

Various changes and modifications are possible within the scope of the inventive concept.

I claim:

1. A socket (1), for receiving the base of a single-based low-pressure mercury vapor discharge lamp having an insertion stem (11) formed with cam surfaces (12), including an elongated, hollow housing having a bottom wall, at least one spring means (5), each having a lower (6) and an upper (7) end, disposed in the socket for holding the lamp in the socket;

detents (8) formed on the spring means (5) and engaging the cam surfaces (12) on the insertion stem (11);

wherein, in accordance with the invention, said socket (1) and said spring means (5) are integrally formed as a single unit;

said lower end (6) of said spring means (5) connects with said elongated housing including the bottom wall thereof;

said upper end (7) of said spring means (5) is free to flex laterally, with respect to the bottom wall of said socket, within a certain range of motion or play; and said socket (1) is formed with at least one stop (10) which limits said play of said upper end (7) of said spring means (5) and which, upon insertion of said stem (11) into said socket, supports said spring means (5) against outward force exerted thereon by said stem (11).

2. A socket as set forth in claim 1, wherein said detents (8) are disposed on said spring means (5) between the lower (6) and upper (7) ends thereof.

3. A socket as set forth in claim 2, wherein said socket (1) has a boundary surface (9) and said at least one stop (10) is formed as a portion of said surface (9).

4. A socket as set forth in claim 3, wherein a plurality of said spring means (5) and a corresponding plurality of stops (10) are provided;

said plurality of spring means (5) and said plurality of stops (10) are dimensioned such that, upon insertion of said lamp base into said socket, the cam surfaces (12) on said insertion stem (11) press said spring means (5) apart, causing the upper ends (7) of the plurality of spring means (5) to press against their respective stops (10), thereby holding the lamp base under spring pressure within said socket.

5. A socket as set forth in claim 4, wherein said detents (8) project from a planar surface of said spring means (5) in a wedge-shaped, double-ramp configuration, two ramp portions of said double-ramp configuration meeting along an apex or junction line perpendicular to the longitudinal axis of said insertion stem (11) and of said elongated housing, the angle of one of said ramp portions, with respect to said planar surface, matching the angle of a portion of said cam surface (12) with respect to a planar side surface of said insertion stem (11).

* * * * *

UNITED STATES PATENT AND TRADEMARK OFFICE

CERTIFICATE OF CORRECTION

PATENT NO. : 4,738,630

DATED : April 19, 1988

INVENTOR(S) : WITTMANN

It is certified that error appears in the above-identified patent and that said Letters Patent is hereby corrected as shown below:

Column 4, line 28 (Claim 4), before "spring means" insert -- plurality of --

Signed and Sealed this

Seventeenth Day of January, 1989

*Attest:*

*Attesting Officer*

DONALD J. QUIGG

*Commissioner of Patents and Trademarks*